US006536234B1

(12) United States Patent
Shah

(10) Patent No.: US 6,536,234 B1
(45) Date of Patent: Mar. 25, 2003

(54) THREE COLUMN CRYOGENIC AIR SEPARATION SYSTEM WITH DUAL PRESSURE AIR FEEDS

(75) Inventor: Minish Mahendra Shah, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/062,672

(22) Filed: Feb. 5, 2002

(51) Int. Cl.[7] ..... F25J 3/00
(52) U.S. Cl. ..... 62/646; 62/647; 62/900
(58) Field of Search ..... 62/643, 646, 647, 62/900

(56) References Cited

U.S. PATENT DOCUMENTS

| | | | | |
|---|---|---|---|---|
| 4,254,629 A | | 3/1981 | Olszewski | 62/13 |
| 4,356,013 A | | 10/1982 | Linde et al. | 62/13 |
| 4,964,901 A | | 10/1990 | Rhode | 62/13 |
| 5,233,838 A | | 8/1993 | Howard | 62/25 |
| 5,245,832 A | | 9/1993 | Roberts | 62/24 |
| 5,463,871 A | | 11/1995 | Cheung | 62/38 |
| 5,582,036 A | | 12/1996 | Drnevich et al. | 62/656 |
| 5,609,041 A | * | 3/1997 | Rathbone et al. | 62/646 |
| 5,675,917 A | * | 10/1997 | Prosser | 62/646 |
| 5,675,977 A | | 10/1997 | Prosser | 62/646 |
| 5,682,764 A | | 11/1997 | Agrawal et al. | 62/646 |
| 6,119,482 A | * | 9/2000 | Bianchi et al. | 62/646 |
| 6,202,442 B1 | * | 3/2001 | Brugerolle | 60/39.12 |
| 6,276,171 B1 | * | 8/2001 | Brugerolle | 62/646 |
| 6,295,838 B1 | | 10/2001 | Shah et al. | 62/643 |

* cited by examiner

*Primary Examiner*—William C. Doerrler
(74) *Attorney, Agent, or Firm*—Stanley Ktorides

(57) ABSTRACT

A three column cryogenic rectification system for producing at least one of oxygen and nitrogen employing a medium pressure column which is operating at a pressure between the operating pressures of the higher and lower pressure columns, and which receives an air feed which is at a lower pressure than the air feed to the higher pressure column. The medium pressure column processes oxygen-enriched liquid from the higher pressure column and is reboiled by a fluid taken from below the top of the higher pressure column.

11 Claims, 3 Drawing Sheets

THREE COLUMN CRYOGENIC AIR SEPARATION SYSTEM WITH DUAL PRESSURE AIR FEEDS

TECHNICAL FIELD

This invention relates generally to the cryogenic rectification of feed air to produce oxygen and/or nitrogen, and is particularly useful for use in an integrated gasification combined cycle system.

BACKGROUND ART

The cryogenic rectification of feed air typically is carried out with a double column system wherein an initial separation is carried out in a higher pressure column and the final separation is carried out in a lower pressure column. The products are produced in the lower pressure column at slightly above ambient pressure. Three column systems are known which can produce oxygen and nitrogen at higher pressures, such as would be useful with a gas turbine system, but such heretofore known systems require a high power input. A three column cryogenic air separation system which can produce products with lower power requirements than heretofore available three column systems would be highly desirable.

Accordingly, it is an object of this invention to provide an improved cryogenic air separation system using three columns to produce oxygen and/or nitrogen which can operate with lower power requirements than heretofore available such systems.

It is another object of this invention to provide an improved three column cryogenic air separation system for use in an integrated gasification combined cycle system.

SUMMARY OF THE INVENTION

The above and other objects, which will become apparent to those skilled in the art upon a reading of this disclosure, are attained by the present invention, one aspect of which is:

A cryogenic rectification method for producing at least one of oxygen and nitrogen comprising:

(A) passing a first feed air stream into a higher pressure column of a cryogenic rectification plant which also comprises a lower pressure column and a medium pressure column, and passing a second feed air stream into the medium pressure column, said second feed air stream being at a pressure which is less than the pressure of the first feed air stream;

(B) producing by cryogenic rectification oxygen-enriched liquid and nitrogen-enriched fluid within the higher pressure column;

(C) passing oxygen-enriched liquid into the medium pressure column and producing intermediate vapor and intermediate liquid by cryogenic rectification within the medium pressure column;

(D) passing a vapor stream taken from below the top of the higher pressure column in indirect heat exchange with intermediate liquid to produce higher pressure liquid and passing higher pressure liquid into the higher pressure column;

(E) passing fluid from the medium pressure column into the lower pressure column and producing nitrogen-richer fluid and oxygen-richer fluid by cryogenic rectification within the lower pressure column; and (F) recovering at least one of the nitrogen-richer fluid and oxygen-richer fluid as product.

Another aspect of the invention is:

An apparatus for producing at least one of oxygen and nitrogen comprising:

(A) a cryogenic rectification plant comprising a higher pressure column, a lower pressure column, and a medium pressure column having a bottom reboiler;

(B) means for passing feed air into the higher pressure column;

(C) means for passing feed air into the medium pressure column;

(D) means for passing fluid from below the top of the higher pressure column into the medium pressure column bottom reboiler, and means for passing fluid from the medium pressure column bottom reboiler into the higher pressure column;

(E) means for passing fluid from medium pressure column into the lower pressure column; and (F) means for recovering fluid as product from at least one of the upper portion of the lower pressure column and the lower portion of the lower pressure column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.* The term, double column, is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column. A bottom reboiler may be located within or outside of the column.

As used herein, the term "intermediate reboiler" means a reboiler that boils liquid from above the bottom of a column. An intermediate reboiler may be located within or outside of the column.

As used herein, the term "top" when referring to a column means that section of the column above the column mass transfer internals, i.e. trays or packing.

Figure 1:
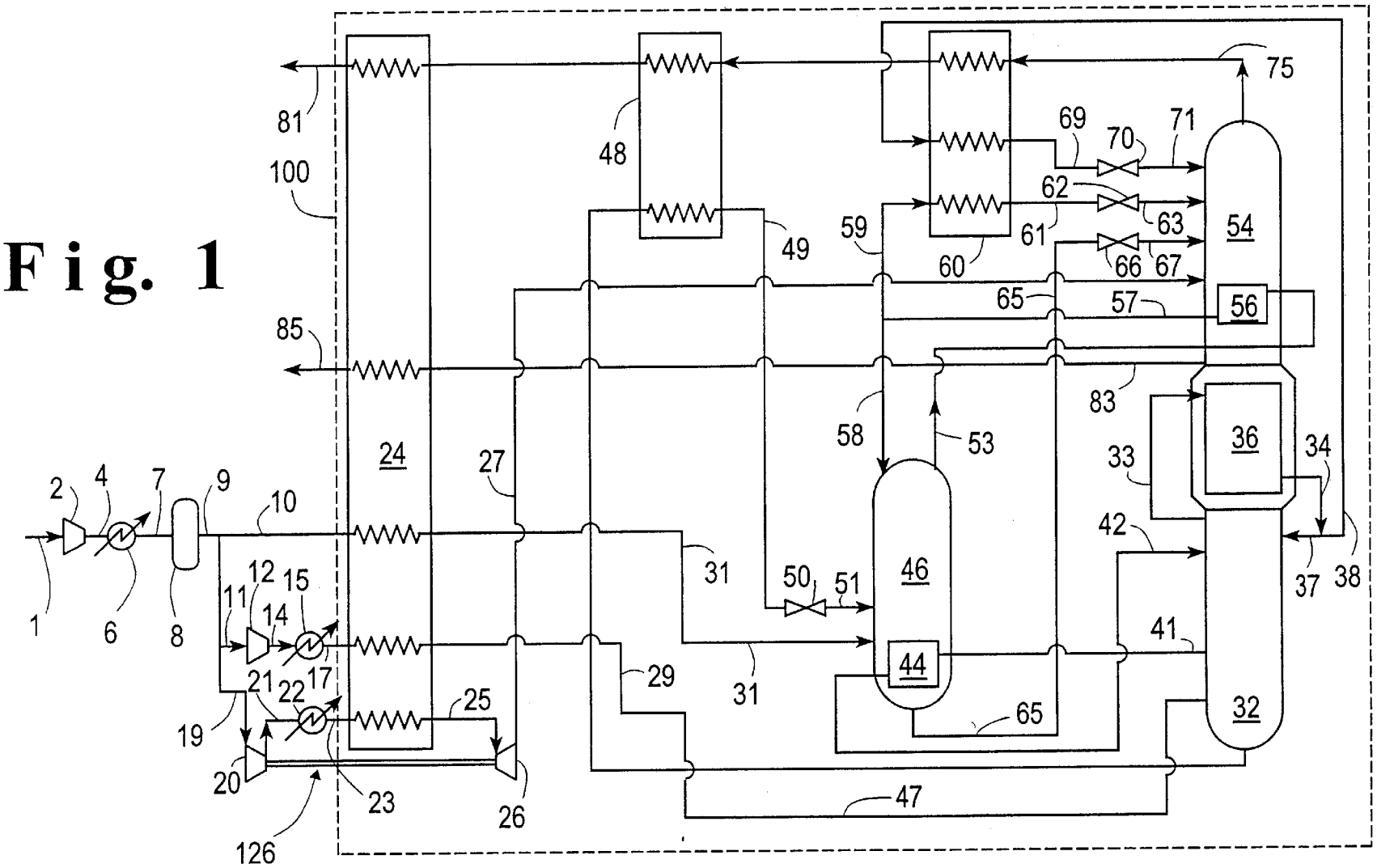
FIG. 1 is a schematic representation of one preferred embodiment of the three column cryogenic air separation system of this invention.

The numerals in the Drawings are the same for the common elements.

DETAILED DESCRIPTION

The invention will be described in detail with reference to the Drawings. Referring now to FIG. 1, feed air 1 is compressed, generally to a pressure within the range of from 50 to 250 pounds per square inch absolute (psia), by passage through compressor 2. Compressed feed air 4 is cooled of the heat of compression in cooler 6 and resulting feed air stream 7 is cleaned of high boiling impurities, such as carbon dioxide and water vapor, by passage through purifier 8. Resulting cleaned compressed feed air 9 is divided into portions 10 and 11.

At least a part of feed air portion 11 is further compressed by passage through compressor 12 to a pressure within the range of from 75 to 350 psia. Resulting further compressed feed air stream 14 is cooled in cooler 15 and as stream 17 is passed into cold box or cryogenic rectification plant 100 which includes a main heat exchanger 24, a higher pressure column 32, a medium pressure column 46, and a lower pressure column 54. Higher pressure column 32 is operating at a pressure generally within the range of from 65 to 340 psia, medium pressure column 46 is operating at a pressure less than that of higher pressure column 32 and within the range of from 40 to 250 psia, and lower pressure column 54 is operating at a pressure less than that of medium pressure column 46 and within the range of from 20 to 120 psia. Feed air stream 17 is cooled in main heat exchanger 24 by indirect heat exchange with return streams and resulting cooled high pressure feed air 29 is passed as a first feed air stream into higher pressure column 32.

Feed air portion 10 is cooled by passage through main heat exchanger 24 by indirect heat exchange with return streams and resulting cooled feed air 31 is passed as a second feed air stream into medium pressure column 46. The pressure of second feed air stream 31 is at least 20 psi, preferably at least 30 psi, less than the pressure of first feed air stream 29. Typically second feed air stream 31 comprises from 1 to 60 percent of the total feed air passed into cryogenic rectification plant 100.

The embodiment of the invention illustrated in FIG. 1 is a preferred embodiment wherein a portion of feed air portion 11 is used to generate refrigeration for the cryogenic rectification. Referring back now to FIG. 1, a portion 19 of feed air portion 11 is passed to compressor 20. Portion 19 typically comprises from 0.5 to 8 percent of the total feed air passed into cryogenic rectification plant 100.

Stream 19 is compressed to a pressure generally within the range of from 75 to 350 psia by passage through compressor 20. Resulting compressed stream 21 is cooled to near ambient temperature by passage through cooler 22 and resulting stream 23 is cooled by partial traverse of main heat exchanger 24. Resulting stream 25 is turboexpanded through turboexpander 26 to generate refrigeration and resulting turboexpanded stream 27 is passed into lower pressure column 54. Energy generated by turboexpander 26 is used to drive compressor 20 through shaft 126.

Within higher pressure column 32 the feed air passed into the column is separated by cryogenic rectification into oxygen-enriched liquid and nitrogen-enriched top fluid. Nitrogen-enriched top fluid is withdrawn as vapor stream 33 from the top of higher pressure column 32. Stream 33 is passed into bottom reboiler 36 of lower pressure column 54 wherein it is condensed by indirect heat exchange with boiling lower pressure column bottom liquid. Resulting condensed nitrogen-enriched top fluid 34 is passed as reflux into both lower pressure column 54 and higher pressure column 32. A first portion 38 of stream 34 is subcooled in heat exchanger 60, subcooled stream 69 is expanded through valve 70, and expanded stream 71 is passed into the upper portion of lower pressure column 54. A second portion 37 of stream 34 is passed into the upper portion of higher pressure column 32. If desired, a portion of liquid nitrogen-enriched top fluid 34 may also be passed into the upper portion of medium pressure column 46 as reflux. If desired, a portion of the nitrogen-enriched vapor 33 may be recovered as nitrogen product.

Oxygen-enriched liquid, having an oxygen concentration generally within the range of from 25 to 40 mole percent, is withdrawn from the lower portion of higher pressure column 32 in stream 47 and subcooled in heat exchanger 48. Subcooled stream 49 is reduced in pressure by passage through valve 50 and passed as stream 51 into medium pressure column 46.

Within medium pressure column 46 the feeds into that column are separated by cryogenic rectification into intermediate vapor and intermediate liquid. Intermediate liquid, having an oxygen concentration generally within the range of from 30 to 60 mole percent, is withdrawn from the lower portion of medium pressure column 46 in stream 65, passed through valve 66, and then passed into lower pressure column 54 as stream 67. Intermediate vapor, having a nitrogen concentration of at least 96 mole percent, is withdrawn from the upper portion of medium pressure column 46 as stream 53 and passed into intermediate reboiler 56 of lower pressure column 54. Resulting nitrogen-containing liquid 57 is divided into stream 58, which is passed into the upper portion of medium pressure column 46 as reflux, and into stream 59 which is subcooled in heat exchanger 60. Resulting subcooled stream 61 is expanded through valve 62 and expanded stream 63 is passed as additional reflux into the upper portion of lower pressure column 54. If desired, a portion of intermediate vapor 53 may be recovered as nitrogen vapor product.

Medium pressure column 46 is driven by a high pressure vapor stream 41 taken from below the top of higher pressure column 32. Stream 41 has an oxygen concentration which exceeds that of the nitrogen-enriched top fluid and which is generally within the range of from 0.5 to 8 mole percent. Stream 41 is taken from a point from 1 to 15 equilibrium stages, preferably 4 to 15 equilibrium stages, below the top of higher pressure column 32. If the stream which is passed into the medium pressure column bottom reboiler were to be taken from above the optimal point defined by this range, the necessary added reflux would not be produced, and if it were to be taken from below this range, product recovery is compromised. Stream 41 is passed into bottom reboiler 44 of medium pressure column 46 wherein it is condensed by indirect heat exchange with medium pressure column bottom liquid. Resulting liquid stream 42 is passed back into higher pressure column 32 at a point at the same level or preferably, as shown in FIG. 1, above the level from which stream 41 is withdrawn from higher pressure column 32.

Because stream 41 has a higher oxygen concentration and therefor higher temperature than the nitrogen-enriched top fluid which reboils the bottom of lower pressure column 54, the bottom of medium pressure column 46, which is reboiled by stream 41, has a higher temperature, generally by from 0.5 to 2.0° K, than the bottom of lower pressure column 54. This higher temperature enables the flow of stream 41 to be increased and results in higher vapor upflow and liquid downflow within medium pressure column 46. This, in turn, increases the flow of intermediate vapor withdrawn from column 46 which results in increased production of additional reflux which can be passed into lower pressure column 54 in stream 63. The additional reflux enables increased product recovery, or the ability to increase the flow of the nitrogen-enriched top fluid or the intermediate vapor, or the ability to increase the pressure of the system, enabling a savings in compression power.

Within lower pressure column 54 the various feeds into that column are separated by cryogenic rectification into nitrogen-richer fluid and oxygen-richer fluid. Oxygen-richer fluid, having an oxygen concentration generally within the range of from 70 to 99.5 mole percent, preferably within the range of from 80 to 98 mole percent, is withdrawn from the lower portion of lower pressure column 54 as stream 83, warmed by passage through main heat exchanger 24, and recovered as product oxygen 85. Nitrogen-richer fluid, having a nitrogen concentration generally of at least 96 mole percent, is withdrawn from the upper portion of lower pressure column 54 as stream 75, warmed by passage through heat exchangers 60 and 48 and main heat exchanger 24 and recovered as product nitrogen in stream 81.

The invention enables a significant reduction in power consumption over conventional three column systems for producing oxygen and/or nitrogen which do not employ dual pressure feed air feeds. The following example and comparative example are presented to demonstrate this advantage. Table 1 shows a computer simulated comparison between a prior art process and the process of present invention. The prior art process was from U.S. Pat. No. 5,675,977. The pressures of air streams shown in Table 1 are at the inlet of the main heat exchanger. In both the cases high pressure air was at 200 psia. In the case of the prior art, all the air was supplied as high pressure air. In the case of the invention, only 60% of air was supplied as high pressure air and the remaining air was supplied at 140 psia to the medium pressure column. The oxygen recovery for the prior art case was 99.43%, which was higher than the recovery of 98.55% obtained with the present invention. However, the power consumption in the present invention was 4.6% lower than with the prior art arrangement.

TABLE 1

| | Invention | Prior Art |
|---|---|---|
| High pressure air, psia | 200 | 200 |
| Low pressure air, psia | 140 | — |
| % of air as high pressure air | 60 | 100 |
| Oxygen recovery, % | 98.55 | 99.43 |
| Relative power | 95.4 | 100 |

A similar comparison was made at even higher pressures. With high pressure air at 250 and 300 psia, the power consumption in the process of the present invention was 2.3% and 1% lower, respectively, compared to the process of U.S. Pat. No. 5,675,977.

Figure 2:
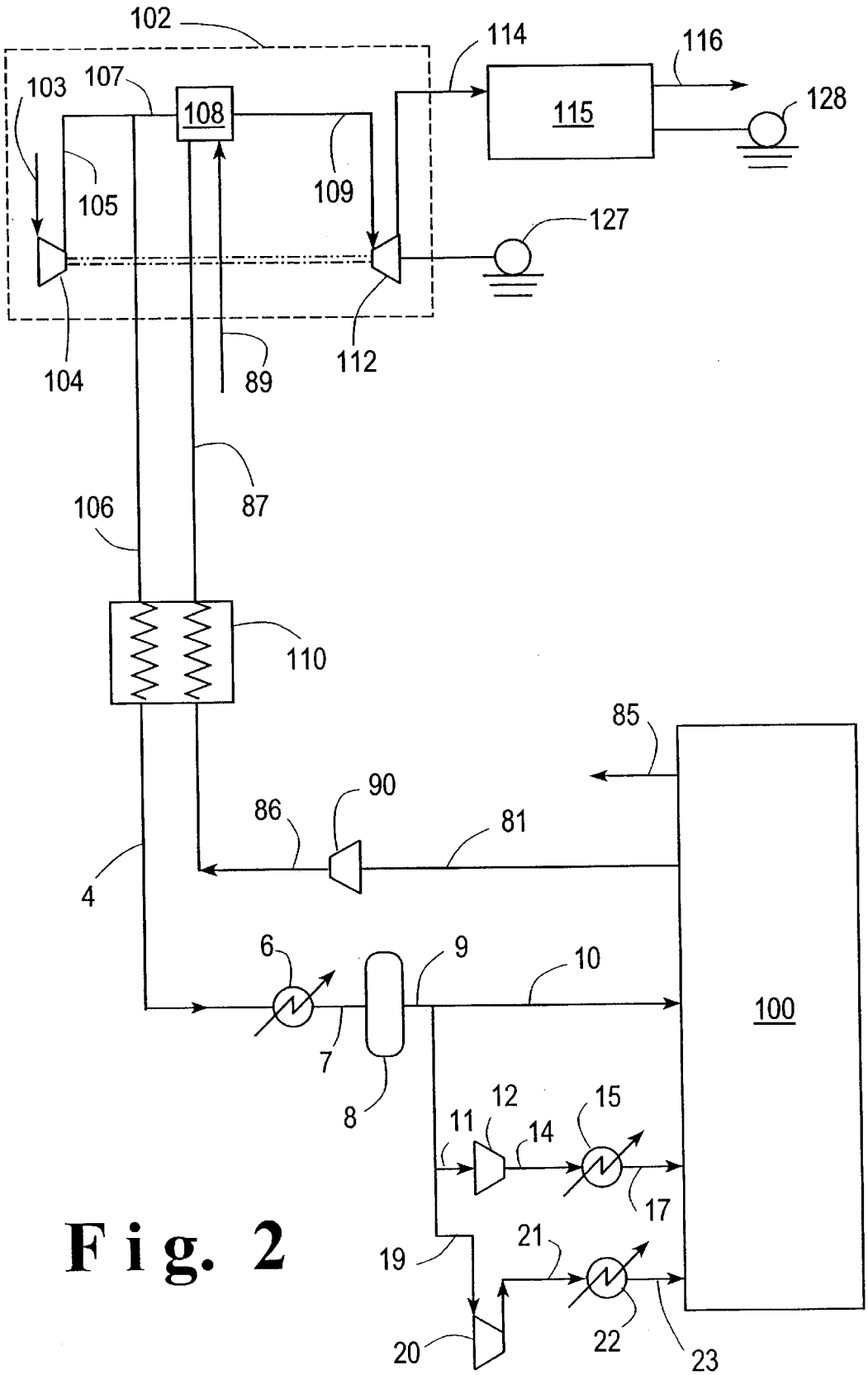
FIG. 2 is a schematic representation of one arrangement whereby the invention may be employed in an integrated gasification combined cycle system.

One very important application of the invention is its use with a gas turbine system either in an integrated gasification combined cycle system or in an integrated combined cycle and air separation unit system. FIG. 2 illustrates one such arrangement of an integrated combined cycle and air separation unit system. The numerals in FIG. 2 are the same as those of FIG. 1 for the common elements and these common elements will not be described again in detail. In FIG. 2 the cryogenic rectification plant 100 is represented in block form.

Referring now to FIG. 2, feed air 103 is compressed by passage through compressor 104 to a pressure generally within the range of from 150 to 350 psia. Resulting compressed feed air 105 is divided into portions 106 and 107. Feed air portion 106 is cooled by passage through heat exchanger 110, emerging therefrom as feed air stream 4 which is processed in a manner similar to that described in conjunction with FIG. 1. Portion 107 is passed into combustor 108 of gas turbine system 102 which also includes compressor 104 and gas turbine 112. Nitrogen product 81 is compressed in compressor 90 to a pressure of from 10 to 100 psi above the pressure of stream 105. Compressed nitrogen stream 86 is warmed by passage through heat exchanger 110 and resulting nitrogen stream 87 is also passed into combustor 108. Fuel 89, such as natural gas, syngas or hydrocarbon liquids, is passed into combustor 108 wherein the fuel and oxygen from compressed air 107 combust to form hot pressurized gas containing combustion reaction products such as carbon dioxide and water vapor. The hot pressurized gas is passed from combustor 108 in stream 109 to gas turbine 112 wherein it is expanded to produce power such as to drive generator 127 to produce electricity.

In the embodiment of the invention illustrated in FIG. 2, nitrogen 87 is passed into combustor 108. Alternatively, nitrogen 87 could be combined with compressed air stream 107 for passage into combustor 108, or could bypass combustor 108 and be passed directly into gas turbine 112. In whatever arrangement is employed, the nitrogen is expanded in gas turbine 112 thereby increasing the amount of power which can be produced by gas turbine 112. The heat brought into the turboexpansion in gas turbine 112 by the heated nitrogen gainfully employs the heat of compression resulting from the compression of the feed air for the cryogenic air separation plant, increasing the efficiency of the overall cryogenic air separation gas turbine integration system.

The exhaust 114 from gas turbine 112 may be sent to steam cycle system 115 for generating steam that can be expanded to produce more power such as by driving generator 128 or may be passed in stream 116 for usage in other processes.

Figure 3:
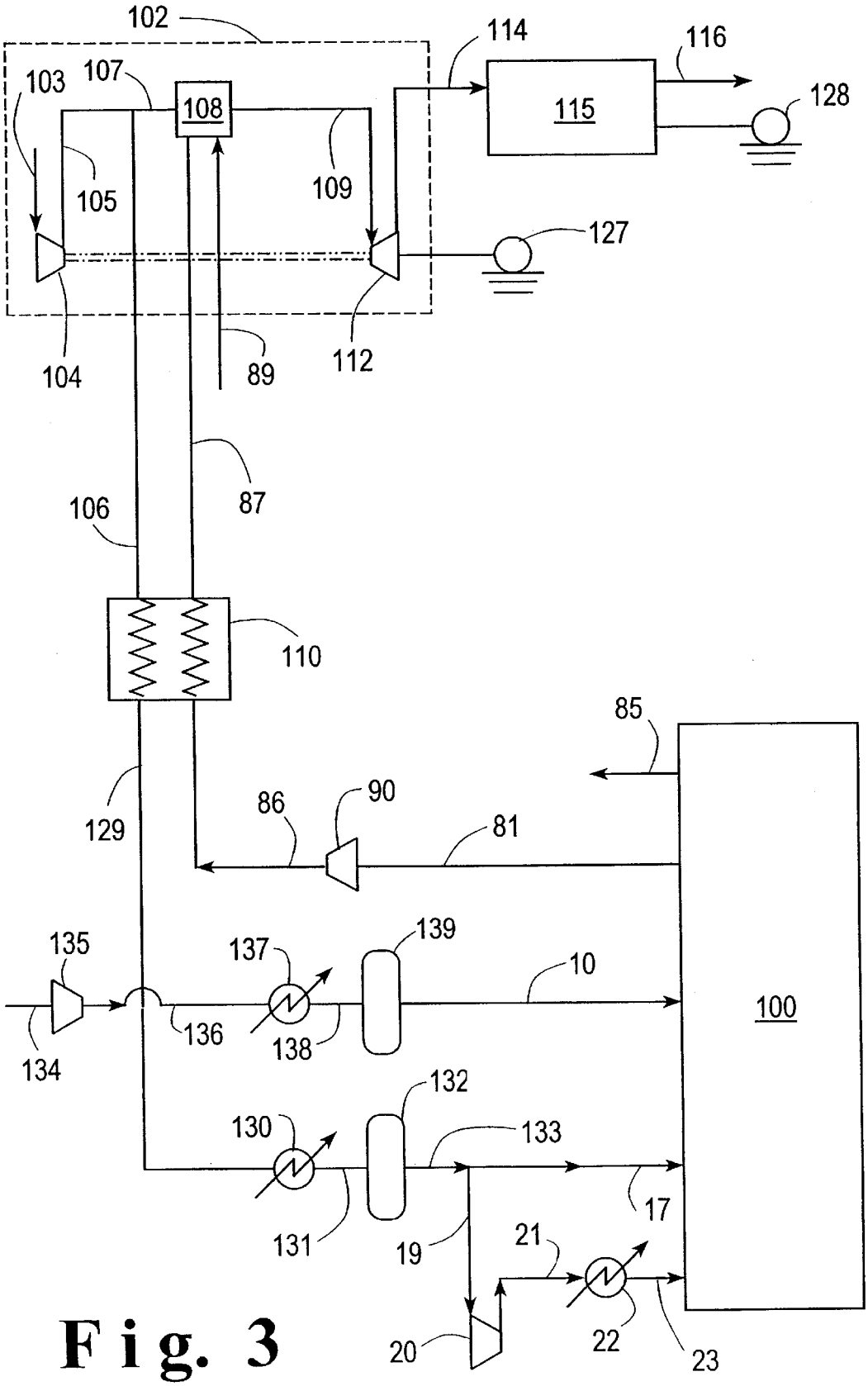
FIG. 3 is a schematic representation of another arrangement whereby the invention may be employed in an integrated gasification combined cycle system.

FIG. 3 illustrates another integrated combined cycle and air separation unit system which can advantageously employ the three column cryogenic air separation system of this invention. The numerals of FIG. 3 are the same as those of FIG. 2 for the common elements and these common elements will not be described again in detail.

Referring now to FIG. 3, the cooled feed air stream 129 from the gas turbine system compressor is used to supply only part of the feed air to cryogenic rectification plant 100. Stream 129 is cooled in cooler 130 and cooled stream 131 is cleaned of high boiling impurities in purifier 132. Resulting cleaned feed air stream 133 is divided into portions 17 and 19 which are further processed in a manner similar to that described in conjunction with FIG. 1. Feed air stream 134 is used to provide the feed air for the medium pressure column. Feed air stream 134 is compressed in compressor 135, resulting stream 136 cooled in cooler 137, and then passed as stream 138 to purifier 139 wherein it is cleaned of high boiling impurities. The feed air emerges from purifier 139 as feed air stream 10 which is further processed in a manner similar to that discussed in conjunction with FIG. 1.

Now, with the practice of this invention, one can effectively produce either or both oxygen and nitrogen product, especially at elevated pressures, without encountering reflux starved column conditions and with lower power requirements than heretofore possible. Although the invention has been described in detail with reference to certain preferred embodiments of the invention, those skilled in the art will recognize that there are other embodiments of the invention within the spirit and the scope of the claims. For example, if oxygen is desired at higher pressure than the pressure in the lower pressure column, then a liquid oxygen pumping arrangement can be used. Instead of withdrawing gaseous oxygen from the lower pressure column, liquid oxygen may be taken from the bottom of the lower pressure column, pumped to the desired higher pressure and then boiled. To boil the higher pressure oxygen liquid, a portion of the high pressure air is further compressed to a higher pressure and condensed by indirect heat exchange with the boiling higher pressure oxygen liquid.

What is claimed is:

1. A cryogenic rectification method for producing at least one of oxygen and nitrogen comprising:

(A) compressing feed air, dividing the compressed feed air into two portions, further compressing one of the portions and passing the further compressed portion as a first feed air stream into a higher pressure column of a cryogenic rectification plant which also comprises a lower pressure column and a medium pressure column, and passing the other portion as a second feed air stream into the medium pressure column, said second feed air stream being at a pressure which is less than the pressure of the first feed air stream;

(B) producing by cryogenic rectification oxygen-enriched liquid and nitrogen-enriched fluid within the higher pressure column;

(C) passing oxygen-enriched liquid into the medium pressure column and producing intermediate vapor and intermediate liquid by cryogenic rectification within the medium pressure column;

(D) passing a vapor stream taken from below the top of the higher pressure column in indirect heat exchange with intermediate liquid to produce higher pressure liquid and passing higher pressure liquid into the higher pressure column;

(E) passing fluid from the medium pressure column into the lower pressure column and producing nitrogen-richer fluid and oxygen-richer fluid by cryogenic rectification within the lower pressure column; and (F) recovering at least one of the nitrogen-richer fluid and oxygen-richer fluid as product.

2. The method of claim 1 wherein the vapor stream is taken from 1 to 15 equilibrium stages below the top of the higher pressure column.

3. The method of claim 1 wherein the higher pressure liquid is passed into the higher pressure column at a level at or above the level from which the vapor stream is taken from the higher pressure column.

4. The method of claim 1 wherein intermediate vapor is withdrawn from the upper portion of the medium pressure column, condensed, and the resulting liquid passed into both the lower pressure column and the medium pressure column.

5. The method of claim 1 wherein nitrogen-richer fluid is recovered as product and passed to a gas turbine system wherein it is employed in a gas turbine to produce power.

6. The method of claim 1 further comprising passing another portion of the compressed feed air to a combustor of a gas turbine system.

7. An apparatus for producing at least one of oxygen and nitrogen comprising:

(A) a cryogenic rectification plan comprising a higher pressure column, a lower pressure column, and a medium pressure column having a bottom reboiler;

(B) a first compressor, a second compressor, means for passing feed air from the first compressor to the second compressor and means for passing feed air into the higher pressure column from the second compressor;

(C) means for passing feed air into the medium pressure column from the first compressor;

(D) means for passing fluid from below the top of the higher pressure column into the medium pressure column bottom reboiler, and means for passing fluid from the medium pressure column bottom reboiler into the higher pressure column;

(E) means for passing fluid from the medium pressure column into the lower pressure column; and (F) means for recovering fluid as product from at least one of the upper portion of the lower pressure column and the lower portion of the lower pressure column.

8. The apparatus of claim 7 wherein the means for passing fluid from below the top of the higher pressure column into the medium pressure column bottom reboiler communicates with the higher pressure column at a level from 1 to 15 equilibrium stages below the top of the higher pressure column.

9. The apparatus of claim 7 wherein the means for passing fluid from the medium pressure column bottom reboiler into the higher pressure column communicates with the higher pressure column at or above the level from which vapor is passed from the higher pressure column into the medium pressure column bottom reboiler.

10. The apparatus of claim 7 further comprising an intermediate reboiler for the lower pressure column, means for passing fluid from the upper portion of the medium pressure column into the intermediate reboiler, and means for passing fluid from the intermediate reboiler into the upper portion of the lower pressure column.

11. An apparatus for producing at least one of oxygen and nitrogen comprising:

(A) a cryogenic rectification plant comprising a higher pressure column, a lower pressure column, and a medium pressure column having a bottom reboiler;

(B) means for passing feed air into the higher pressure column;

(C) means for passing feed air into the medium pressure column;

(D) means for passing fluid from below the top of the higher pressure column into the medium pressure column bottom reboiler, and means for passing fluid from the medium pressure column bottom reboiler into the higher pressure column;

(E) means for passing fluid from the medium pressure column into the lower pressure column;

(F) means for recovering fluid as product from at least one of the upper portion of the lower pressure column and the lower portion of the lower pressure column; and (G) a gas turbine system comprising a compressor, a combustor and a gas turbine, and further comprising means for passing product recovered from the lower pressure column to the gas turbine system wherein the means for passing feed air into the higher pressure column includes the compressor of the gas turbine system, and the means for passing feed air into the medium pressure column does not include the compressor of the gas turbine system.

* * * * *